US010202894B2

(12) United States Patent
Mair

(10) Patent No.: US 10,202,894 B2
(45) Date of Patent: Feb. 12, 2019

(54) INTERNAL COMBUSTION ROTARY ENGINE

(75) Inventor: Georg Johann Mair, Pfitsch (IT)

(73) Assignee: MAIR'S—DREHSCHIEBENMOTOR, INC., Beaverton, OR (US)

( * ) Notice: Subject to any disclaimer, the term of this patent is extended or adjusted under 35 U.S.C. 154(b) by 454 days.

(21) Appl. No.: 14/386,214

(22) PCT Filed: Mar. 20, 2012

(86) PCT No.: PCT/EP2012/054924
§ 371 (c)(1),
(2), (4) Date: Sep. 18, 2014

(87) PCT Pub. No.: WO2013/139381
PCT Pub. Date: Sep. 26, 2013

(65) Prior Publication Data

US 2015/0034041 A1 Feb. 5, 2015

(51) Int. Cl.

| | |
|---|---|
| ***F02B 53/00*** | (2006.01) |
| ***F02B 53/04*** | (2006.01) |
| ***F01C 1/344*** | (2006.01) |
| ***F01C 1/356*** | (2006.01) |
| ***F01C 21/10*** | (2006.01) |
| ***F02B 53/10*** | (2006.01) |
| ***F02B 53/12*** | (2006.01) |

(52) U.S. Cl.
CPC ..... *F02B 53/04* (2013.01); *F01C 1/344* (2013.01); *F01C 1/356* (2013.01); *F01C 21/106* (2013.01); *F02B 53/10* (2013.01); *F02B 53/12* (2013.01); *F04C 2250/30* (2013.01)

(58) Field of Classification Search
CPC ..... F02B 53/04; F02B 53/12; F02B 53/10; F01C 21/106; F01C 1/356; F01C 1/344; F04C 2250/30
USPC ..... 123/241, 245
See application file for complete search history.

(56) References Cited

U.S. PATENT DOCUMENTS 1,424,977 A * 8/1922 Bidwell ..... F16J 15/34 123/231
3,160,147 A * 12/1964 Hanson ..... F25B 1/04 123/229
3,304,921 A * 2/1967 Prochazka ..... F01C 1/073 123/245
3,422,801 A * 1/1969 Mido ..... F01C 1/3562 123/229

(Continued)

FOREIGN PATENT DOCUMENTS

DE 10 2007 020 337 A1 11/2008
WO WO 8801336 A1 * 2/1988 ..... F01C 1/3446
WO WO2012089864 * 7/2012 ..... F02B 53/04

*Primary Examiner* — Thai Ba Trieu
(74) *Attorney, Agent, or Firm* — Jacobson Holman, PLLC.

(57) ABSTRACT

An internal-combustion engine includes an engine housing having an interior space with an inner wall, which section-wise corresponds to a segment of a circular cylinder and a segment deviated from the circular cylinder, wherein a rotary disc is centrally rotatably mounted in the interior space around an axis, and an intake area, a compression area, an ignition area, a working area and an exhaust area are formed, wherein the rotary disc is a circular cylinder with two slots in the circumferential area, into each of which slots a sliding element is inserted, wherein each sliding element movable along the slot, and is moved along the slot on rotation of the rotary disc.

14 Claims, 6 Drawing Sheets

(56) References Cited

U.S. PATENT DOCUMENTS

| | | | | |
|---|---|---|---|---|
| 3,467,070 | A * | 9/1969 | Green | F02B 53/00 123/229 |
| 3,540,816 | A * | 11/1970 | Alcolea | F02B 53/00 418/177 |
| 4,667,468 | A * | 5/1987 | Hansen | F01C 1/3441 123/248 |
| 7,077,098 | B2 * | 7/2006 | Shuba | F02B 53/02 123/231 |
| 2008/0135012 | A1 | 6/2008 | Shuba | |
| 2008/0276903 | A1 * | 11/2008 | Gorb | F01C 1/3442 123/243 |
| 2009/0050080 | A1 * | 2/2009 | Hair, III | F01C 1/44 123/3 |
| 2010/0122684 | A1 * | 5/2010 | De Oliveira | F01C 1/3446 123/223 |

* cited by examiner

INTERNAL COMBUSTION ROTARY ENGINE

BACKGROUND OF THE INVENTION

The invention concerns an internal-combustion engine, comprising an engine housing, wherein a rotary disc is centrally rotatably mounted in the interior space of the engine housing around an axis of rotation.

Industrially produced internal-combustion engines are currently designed almost exclusively on the principle of reciprocating piston engines. Reciprocating piston engines are engines in which a change in volume of a gas is reacted on a linearly moving piston by means of a connecting rod and a crank to a rotary movement. From the reciprocating piston engines are to be distinguished the rotary engines. These are internal-combustion engines, in which the parts which perform mechanical work, carry out only rotational movements.

While the theoretical benefits of rotary engines compared to reciprocating engines, such as the reduced number of moving parts and concomitant a robust construction, the absence of a power transmission means crankshaft, the smoother running due to the orbital motion and ultimately a lower power to weight ratio, are well known, the rotary engines could not claim right so far. Known drawbacks of rotary engines such as sealing problems, unfavorable combustion chambers compared to cylindrical combustion chambers for piston engines, difficult lubrication and sometimes difficult-to-handle components have as a result, that with the exception of the Wankel engine hardly a rotary engine has reached the production stage.

DE 10 200 020 337 A1 describes a rotary piston engine with a cylindrical piston circulating in an engine housing. The engine housing forms a circular-cylindrical interior, in which a circular-cylindrical piston rotates, which has a smaller outer diameter than the interior. Interior and piston have a common axis, so that there is an annular gap between the inner wall of the interior and the piston outer wall. The piston also has four projections, each forming chambers in the engine compartment. However, the rotary engine in DE 10 2007 020 337 A1 turns out to be not ideal in terms of the combustion chamber shape and seal.

BRIEF SUMMARY OF THE INVENTION

The object of the present invention is to provide an internal-combustion engine of the type abovementioned, in which the known drawbacks of rotary engines are reduced, and that is suitable for serial employment.

This object is solved by an internal-combustion engine, comprising an engine housing, which has an interior space with an inner wall, which section-wise corresponds to a segment of a circular cylinder and section-wise corresponds to a segment, which deviates from the form of a circular cylinder, wherein a rotary disc is centrally rotatably mounted in the interior space around an axis of rotation, and an intake area, a compression area, an ignition area, a working area and an exhaust area are formed, wherein the rotary disc is designed substantially in the form of a circular cylinder, wherein said rotary disc has two slots in the circumferential area, into each of which slots a sliding element is inserted, wherein the engine housing has a slot into which a sliding element is inserted, wherein each sliding element is able to move along the slot concerned, wherein a guide is provided for each sliding element, so that the sliding element is moved along the slot concerned on rotation of the rotary disc, wherein the end of the first, sliding element facing away from the axis of rotation is guided along the inner wall in the compression area, ignition area and working area on rotation of the rotary disc, while the end of the second sliding element facing away from the axis of rotation is guided along the inner wall in the compression area and at a distance from the inner wall in the working area on rotation of the rotary disc.

The construction and operation of the objectively invention is based on an innovative concept that is guaranteed with the greatest simplicity in its form. It is the basic principle of a very low friction rotary disc engine or more specifically a centric around rotating internal-combustion engine and heat engine of any kind. The concept of the invention has the advantage that no springs are required. Springs have the disadvantage that the spring effect decreases due to wear and the speed with which the springs can move is limited by the spring characteristics.

Decisive is the centric continuous rotational movement around, i.e. the performance does not need to be converted into a centric rotational movement for driving a load. By the fact that the power development precisely occurs in the direction of the rotation of the rotary disc, eccentric and crank drive can be omitted. It is thus a very compact construction possible, also because this technique does not require valve operation.

Intake area, compression area, ignition area, working area and exhaust area are distributed at the axis of rotation at a 360° rotation. The working area preferably takes in the greatest part and most preferably extends through at least 180° around the rotating axis.

Depending on the field of application and power demand one or more such rotary discs can be provided. Preferably, the rotary discs are then offset from one another. The rotary discs can be connected directly to a drive shaft and a flywheel for example.

It is preferably provided that the interior space is connected with a fuel inlet and an exhaust outlet, wherein arranged between fuel inlet and exhaust outlet are the compression area, the ignition area and the working area, wherein the segment of the inner wall, which deviates from the form of a circular cylinder, substantially disposed at the intake area and the compression area.

Further it is preferably provided that the outer diameter of the rotary disc in the area where the inner wall corresponds to a circular cylinder substantially corresponds to the inner diameter of the interior and wherein the inner diameter of the inner wall in the area where it deviates from the form of a circular cylinder exhibits a larger diameter than the rotary disc.

It can further be provided that the radial distance from the inner wall of the at least one recess in the rotary disc of the first sliding element in the compression area, the ignition area and the working area remain essentially unchanged. As well it can further be provided that the radial distance from the inner wall of the at least one recess in the rotary disc of the second sliding element only in the ignition area and only in the work area remain essentially unchanged, while particular change in the compression area.

It is particularly preferred that the rotary disc on the top surfaces of the circular cylinder in the radial direction each exhibits an overlap.

Preferably the third sliding element is inserted slidable from and to the axis of rotation. It is particularly preferred that the third sliding element upon rotation of the rotary disc along the third slot is moved toward the rotary disc and from the rotary disc away, wherein the guide is formed such that the third sliding element after passing the first sliding element, is moved toward the rotary disc and preferably earliest once the first sliding element preferably once also the second sliding element has passed the outlet area, is reinserted into the engine housing. Accordingly it is advantageous when the second sliding element retracted at the passing of the third sliding element in the slot of the rotary disc, so there is no overlap.

In one embodiment, it is provided that the third shift element has projections that are performed during the rotation of the rotary disc in recesses of the overlaps.

Preferably it is provided that the sliding elements are displaced to each other.

Further is provided in one embodiment that the sliding elements have at least one projection parallel to the axis of rotation. Preferably two projections are provided, although only one projection is sufficient, for example if an additional stabilizing element is provided. The projection or the projections extend into recesses of the engine housing. The projections may be formed as pins for example, which are shaped so that they perfectly in the recesses glide, which are formed as guide grooves for example. The projections reach for purposes of guidance in corresponding recesses of the engine housing.

It is preferably provided that these recesses are guide grooves. In a particularly preferred embodiment can be provided that the recesses form a closed curve around the axis of rotation.

In another embodiment of the invention can be provided that the two sliding elements of the rotary disc with respect to their different work processes are guided by each separate guide grooves with some from differing course of curve.

Further it can be provided that an air inlet is provided and that an injection device is provided, with which air and fuel are introduced into a gap between the inner wall and the rotary disc.

Within the invention it is possible that the fuel/air-mixture ignites self igniting in the combustion chamber or it is extraneous ignited. It can be provided an air inlet and an injection device, with which air and fuel are introduced into a gap between the inner wall and the rotary disc.

Further it is preferably provided that the rotary disc exhibits a shaft for the driving a load.

It is preferably provided that the first and the second sliding element are slidable in the radial direction.

Preferably the first and second and preferably also the third slot are directed substantially towards the axis of rotation.

By the movement of the sliding elements in a radial direction (mainly of the first and of the second sliding element) is created an imbalance in the rotary disc. This imbalance can be compensated by one or more counterweights. Preferably these counterweights are movable in the radial direction and can also be extended by moving out of the sliding elements. During retraction of the sliding elements, these counterweights can be recovered. The drive of the counterweight can also be achieved by a forced guide, for example by means of recesses and projections (similar to the slide elements) or by means of an active actuator (e.g. a hydraulic pump).

The above illustrations applies in an equivalent manner also for a reverse arrangement in which instead of a circular cylindrical shaped rotary disc in an inner space, that is only partly a circular cylindrical shaped, also in the reverse manner. Here the internal space would then circular cylindrical shaped, the rotary disc would have flattened sections. The first and second sliding element would then not in the rotary disc, but in the engine housing movable along slots and the recesses would be disposed on the rotary disc, in which the sliding elements are forced guided. The third sliding element would then be guided into a slot on the rotary disc, the corresponding recesses are located in the engine housing.

The explosions of the combustion gases always work with optimum, i.e. is in an exactly 90° angle to the radius of rotation of the rotary axis, that act always in the direction of rotation. This promises the greatest possible force development for an internal combustion engine and thus a high level of efficiency respectively significant energy utilization. This is made possible by the three sliding elements. The three sliding elements move synchronized to their respective progresses of work profiles in separate guide grooves, each with a corresponding course of curve.

Depending on the dimensions of the internal combustion engine these can be find a use in all imaginable applications. Exemplarily can be mentioned: As an engine for an engine vehicle such as car, motorcycle, truck, as a boat engine, as an aircraft engine, as an engine for power generation, etc.

BRIEF DESCRIPTION OF THE DRAWINGS

Further advantages and details of the invention will to be illustrated below on the basis of figures and figure descriptions.

DETAILED DESCRIPTION OF THE PREFERRED EMBODIMENTS

Figure 9:
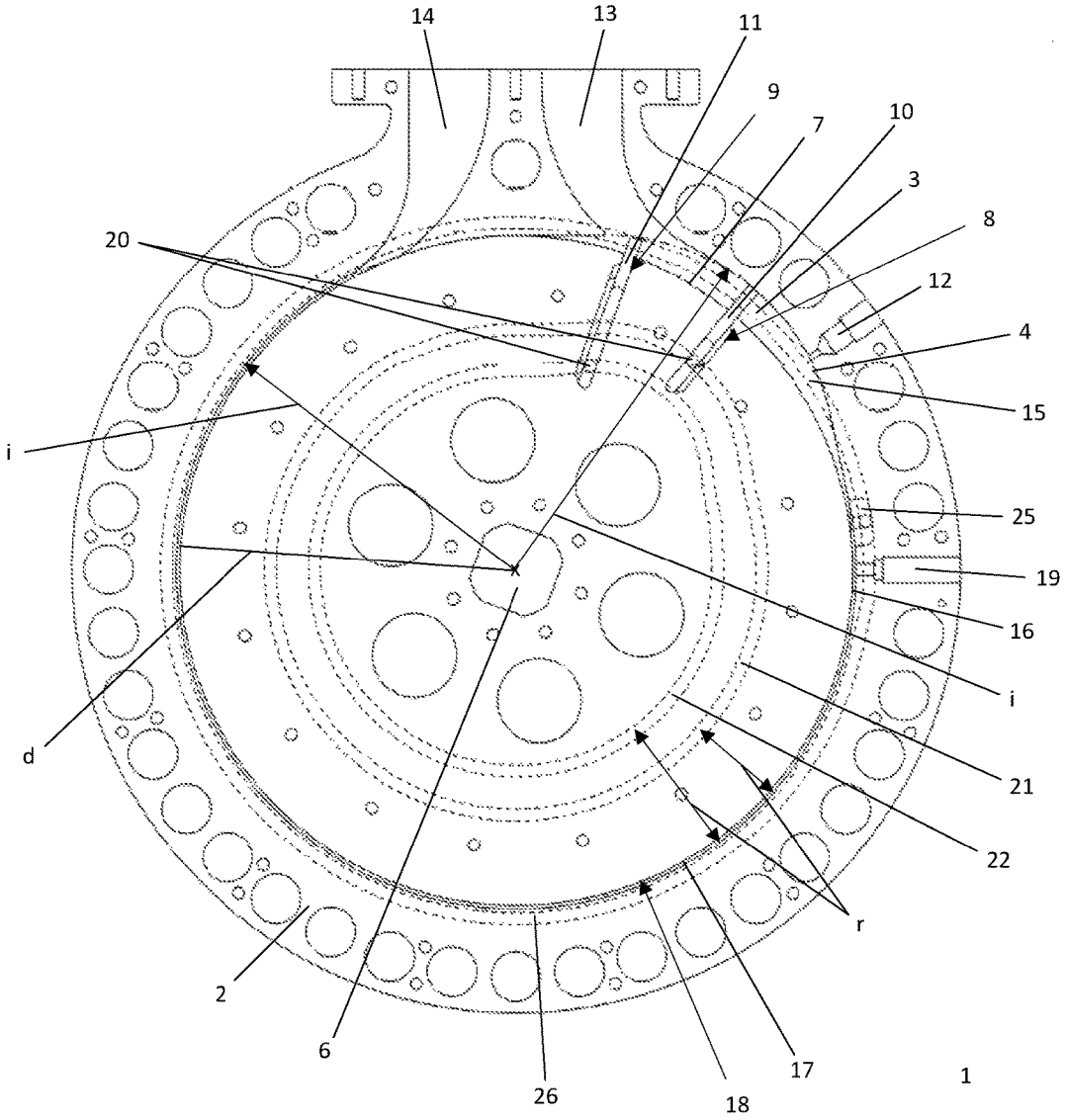
FIG. 9 shows a magnification of FIG. 1*a*.

In FIGS. 1*a* to 1*d* and in the magnified view in FIG. 9 an internal combustion engine 1 according to the invention is shown. The internal combustion engine 1 comprises an engine housing 2, which has an interior space 3 with an inner wall 4. The inner wall 4 section-wise corresponds to a segment of a circular cylinder and section-wise deviates from the form of a circular cylinder. A rotary disc 5 is centrally rotatably mounted in the interior space 4 around an axis of rotation 6, wherein the rotary disc 5 is designed substantially in the form of a circular cylinder. The rotary disc 5 in the circumferential area 7 has a first slot 8 and a second slot 9. In the first slot 8 is inserted a first sliding element 10 and in the second slot 9 a second sliding element 11. The sliding elements 10, 11 are arranged offset to each other.

Both the first and the second sliding element 30, 11 are displaceable in the radial direction. The two slots 8, 9 are substantially directed to the rotating axis 6.

The two sliding elements 10, 11 are movable along the slots 8, 9 and can be moved in this way from and to the rotation axis 6. The end of the first sliding element 10 facing away from the axis of rotation 6 at a rotation of the rotary disk 5 is guided essentially along the inner wall 4, while the end of the second sliding element 11 facing away from the axis of rotation 6 upon a rotation of the rotary disc 5 only section-wise along the inner wall 4 is guided. Specifically the end of the first sliding element 10 facing away from the axis of rotation 6 at a rotation of the rotary disc 5 in the compression area, in the ignition area and in the working area is guided along the inner wall 4. The end of the second sliding element 11 facing away from the axis of rotation 6 upon a rotation of the rotary disc 5 in the compression area along the inner wall 4 is guided. From the third sliding element 25 the second sliding element 11 is retracted and guided with distance to the inner wall 4 along the working area, so that the third sliding element 23 forms the rear boundary of the combustion chamber 18.

Figure 1A:
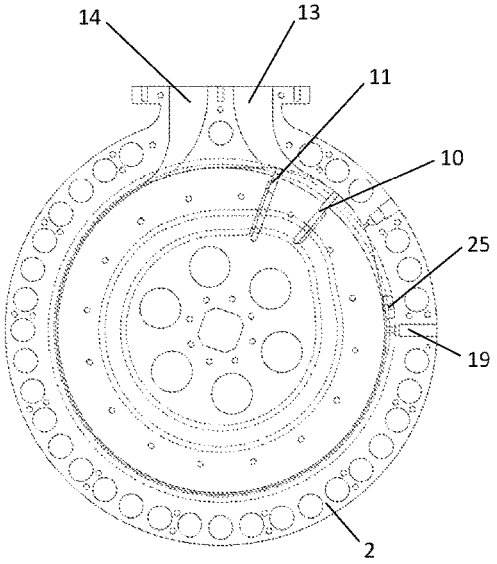
FIGS. 1*a* to 1*d* show cross-sections through a combustion engine according to the invention in four operating positions: suction (FIG. 1*a*), compression (FIG. 1*b*), work (FIG. 1*c*), ejecting (FIG. 1*d*).
Figure 1B:
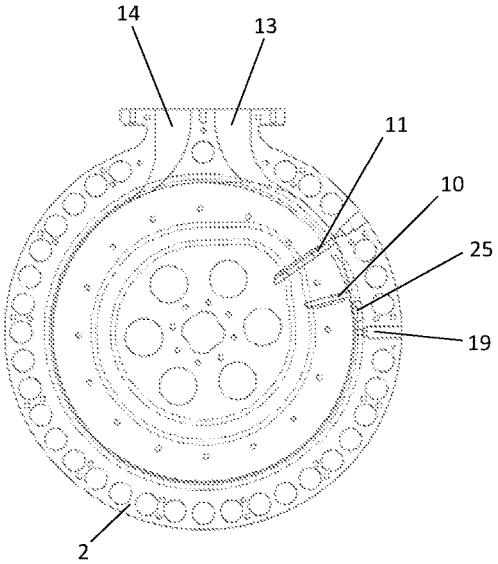
Figure 1C:
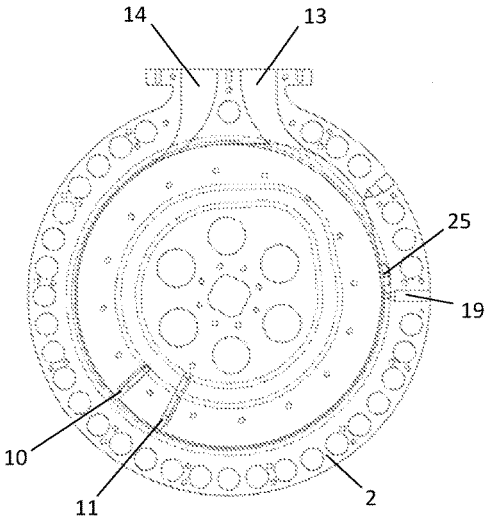
Figure 1D:
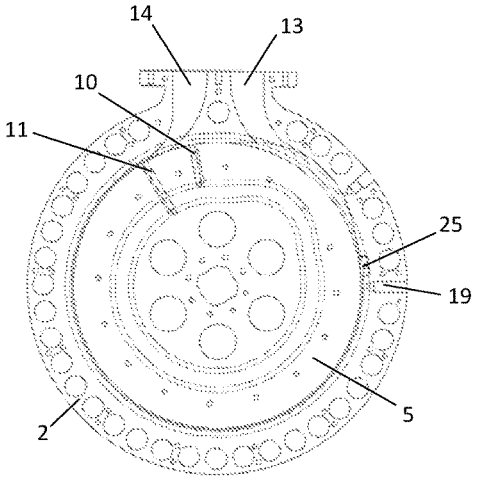

The interior space 3 is connected with an air inlet 13, a fuel inlet 12 and an exhaust outlet 14, wherein between the fuel inlet 12 and the exhaust outlet 14 are arranged a compression area 15, an ignition area 16 and a work area 17. The segment of the inner wall 4, which differs from the circular cylindrical shape, is arranged substantially in the inlet area and compression area 15. The two sliding elements 10, 11 define the combustion chamber 18 in which initially will let air into, which is then compressed and mixed with fuel. Subsequently the ignition of the fuel/air mixture occurs in the combustion chamber 18 and at that starts the working cycle. FIG. 1*a* shows the working area in which in the inlet area an air intake 13 occurs. FIG. 1*b* shows the compression area 15 with the fuel inlet 12. The ignition of the fuel/air mixture is occurs with the ignition device 19 which is formed for example as an electric spark plug. With appropriate dimensioning of the combustion chamber and a correspondingly high compression as well as at use of a suitable fuel, in addition to the described extraneous ignition with an igniter 19 may be provided also a self ignition. After occurred ignition in FIG. 1*c* is provided the working cycle in which the burnt fuel/air mixture by means of the rotary disc 5 converts energy into rotation. The rotary disc 5 is provided with a shaft not shown for driving a load, also not shown. FIG. 1*d* finally shows the expulsion of the burned fuel/air mixture in the outlet area on the exhaust outlet 34.

As it can be seen from the FIGS. 1*a* to 3*d*, the outer diameter d of the rotary disc 5 in the area where the inner wall 4 corresponds to a circular cylinder substantially corresponds to the inner diameter 13 of the interior space 3. The inner diameter 12 of the inner wall 4 in the area where it deviates from the circular cylindrical shape, exhibits a larger diameter d than the rotary disc 5.

Figure 2A:
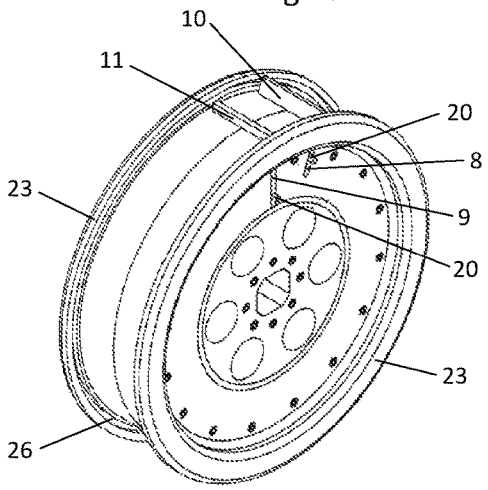
FIGS. 2*a*, 2*b* show perspective views of engine discs with two sliding elements (Front and back).
Figure 2B:
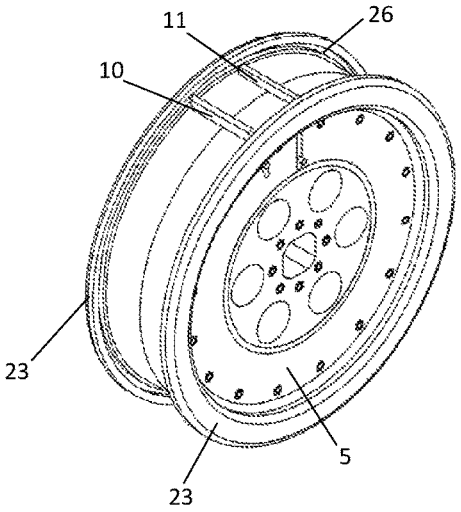
Figure 3:
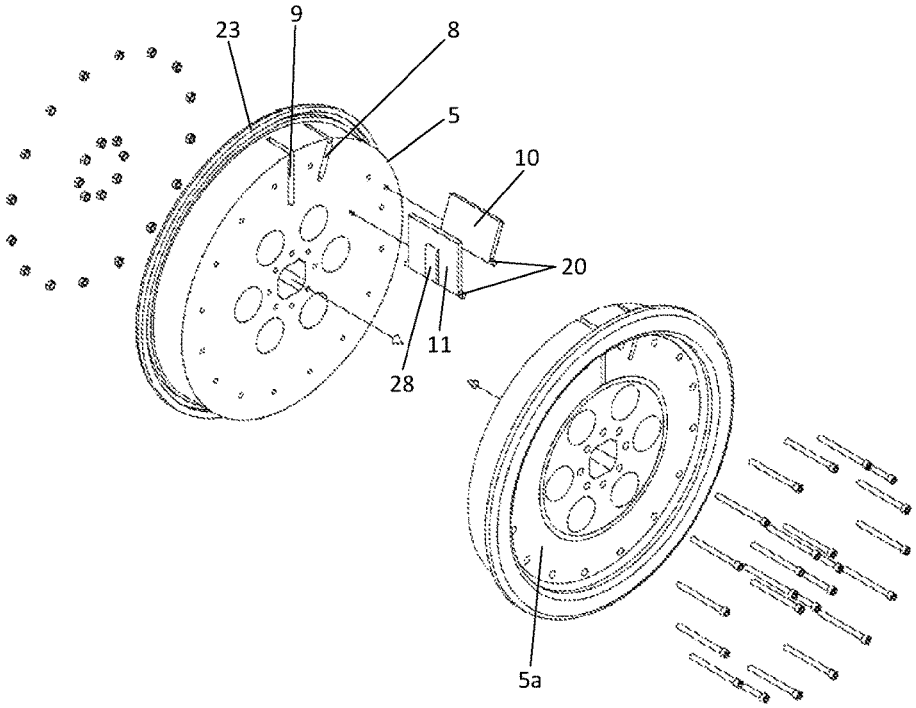
FIG. 3 shows an exploded view of an engine disc.
Figure 4A:
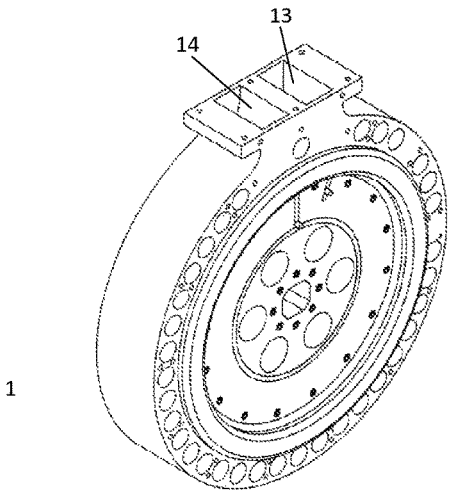
FIGS. 4*a*, 4*b* show perspective views (front and back) of an engine disc with housing.
Figure 4B:
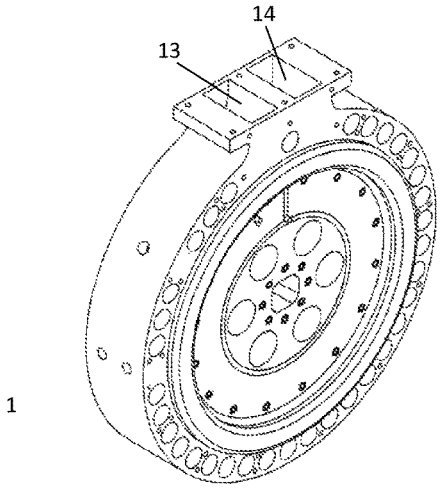
Figure 5A:
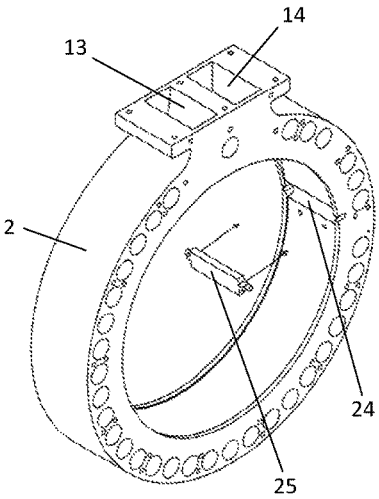
FIGS. 5*a*, 5*b* show the third sliding element in the engine housing.
Figure 5B:
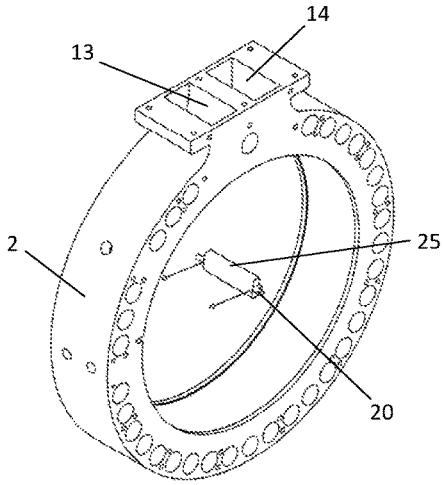
Figure 6:
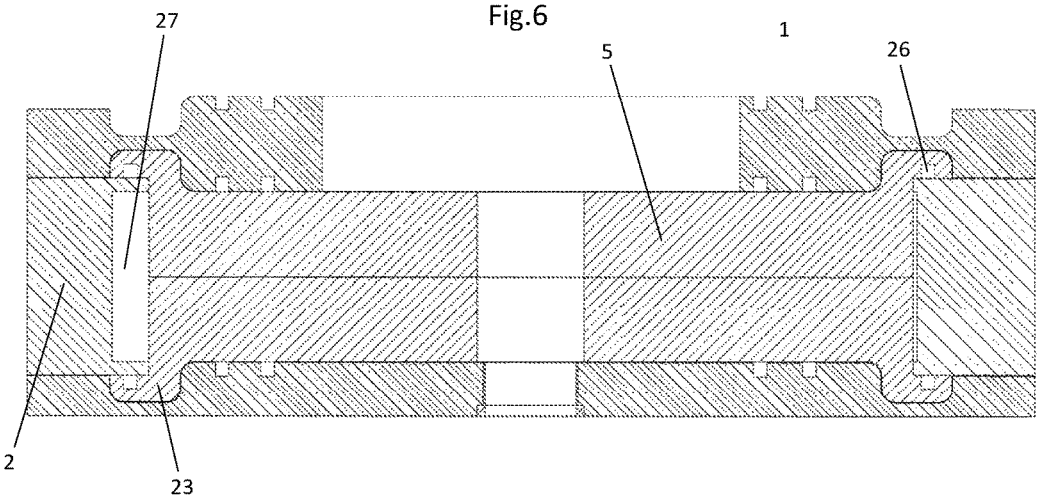
FIG. 6 shows a cross-section of the rotary disc and the engine housing.
Figure 7A:
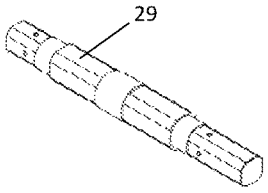
FIGS. 7*a* to 7*c* show three design variants for profiled engine shafts.
Figure 7B:
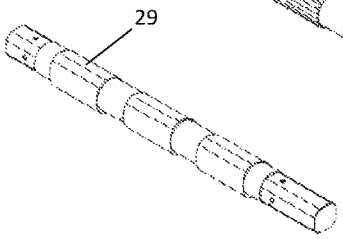
Figure 7C:
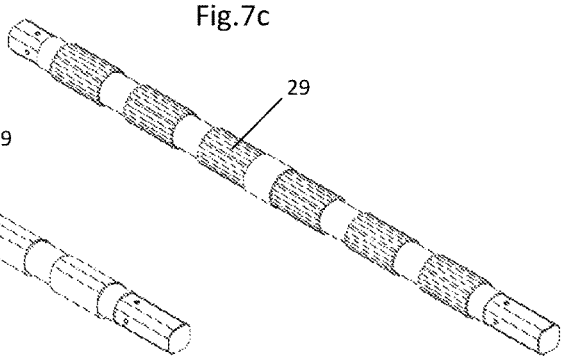
Figure 8A:
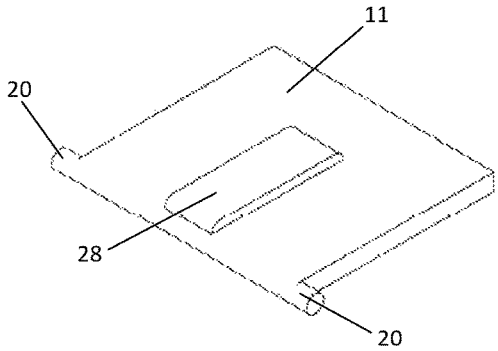
FIGS. 8*a* to 8*c* show design variants for sliding elements.
Figure 8B:
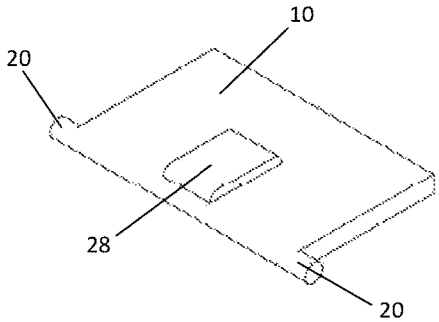
Figure 8C:
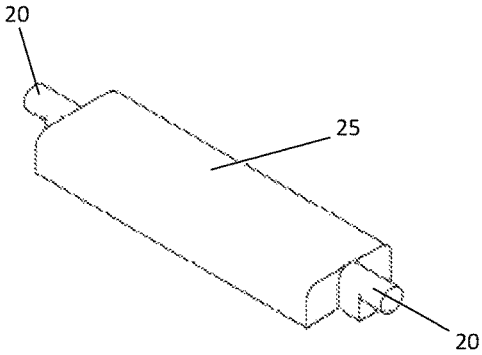

As it can be seen from the FIGS. 2*a*, 2*b* and 3, the sliding elements 10, 11 parallel to the axis of rotation 6 exhibit projections 20, which extend into recesses 21, 22 of the engine housing 2. The recesses 21, 22, form a closed curve around the rotation axis 6. The radial distance r of the recesses 21, 22 from the inner wall 4 substantially remains unchanged around the rotation axis 6 in the compression area 15, in the ignition area 16 and the working area 17.

The FIG. 3 shows clear that the rotary disc 5 on the top surfaces 5*a* of the circular cylinder in the radial direction exhibit overlaps 23. The interior space 3 of the engine housing 2 exhibit a slot 24 in which a third sliding element 25 is movable mounted to and from the rotation axis 6. Also the third sliding element 25 exhibits projections 20 which are guided in recesses, which are preferably milled guide grooves 26 in the overlaps 23.

Between interior space 3 and rotary disc 5 is a gap 27. This is sealed by the overlaps 23 from the remainder engine. With the air intake 13 and by way of the fuel inlet 12 in the form of an injection device it is injected air and fuel in the gap 27 between inner wall 4 and rotary disc 5, which thus in sections forms also the combustion chamber 18.

With the mentioned three sliding elements 10, 11, 25 per rotary disc 5, which are generally present in plate form, can be formed an intake area, a compression area, a combustion chamber and an exhaust area per rotary disc.

The rotary disc 5 is mounted centrally and has a circular cylindrical shape. Its diameter and its width depend entirely on sought-use and power of the internal-combustion engine 1. The rotary disc 5 preferably has approximately parallel to each other across milled in the arc two slots 8, 9, in which the first two sliding elements 10, 11—also named as compressor and mover—have their place. These two movable sliding elements 10, 11 form the front and rear sides of the combustion chamber 18, and are guided on the especially milled form of the engine housing 2 inside along. Depending on the position of the rotary disc 5 in the engine-housing 2, the slide elements 10, 11 are in forth or back pushed position, i.e. in combination with the rotating rotary disc 5, with the correspondingly shaped inner surface of the engine housing 2 and finally with the third sliding element 25 (=stop) fitting in the engine housing 2, they make possible the volume of the combustion chamber 18.

The third sliding element 25 is seated according to position at the beginning of the expansion phase in an across milled slot 24 in the engine housing 2. It is advanced in the moment when the back side of the combustion chamber 18, that is the second sliding element or the compressor 11, is inserted compliant and thus serves as a stop for the combustion. Through this the expansion of the combustion forward is made possible and thus by its pressure on the front or first sliding element 10 (=mover) the development of power.

This concept of the development of power is very beneficial: First, because the way of the expansion phase is a sight longer as the one of the compression phase (the ratio varies depending on the geometry of the engine) and because this way the power can develop unfettered forward. Second, because in such an internal-combustion engine 1 the principle of continuously infinite movement in his effect is met in its best, if the way of the development of power corresponds to this round movement.

The third sliding element 25 will be only then reinserted flush into the engine housing 2, if through the corresponding position of the rotary disc 5 de novo fresh air is sucked into the combustion chamber 18. So the way will be free, and the first sliding element 10, the mover of the combustion chamber 18, pushes now, during the repetitive intake and compression process, the burned gases from the previous power stroke. The first two disposed sliding elements 10, 11 (the compressor 11 and the mover 10) in the rotary disc 5, are moved by suitably milled guides into the engine housing 2, whereas the third sliding element 25 (=stop) located in the engine housing 2 will be moved by appropriately milled guide grooves 26 in the rotary disk 5.

Integrated into the engine housing 2 are the oil and water cycle and in addition to the preferred arranged in pairs intake and exhaust manifold, also the fuel injection and ignition system and ail milled threads that are needed for the assembly of the oil pan and auxiliary units such as the alternator and water pump.

The choice of material for the construction of the internal-combustion engine depends on the current state of research material and thus also on the availability of further development of the most suitable materials. Even newer techniques in materials processing, such as e.g. the surface treatment by laser milling, the so-called honing, cause simply by optimizing of the lubricity of the engine parts an another significant reduction in friction and thus a considerable improvement in quality in the matter of attrition, function and durability.

The internal-combustion engine operates in four strokes that to take place within each exactly one full rotation of the rotary disc. This entire four-stroke process, namely intake, compression, work and exhaust, also repeated anew with each engine rotation. Due to the particularity that the combustion chamber is connected to the rotary disc and therefore rotates with her, the progress of work can change a bit as to the point and timing of the fuel injection or an extraneous ignition such as an electrical/electronic ignition.

For the present invention, are possible both an extraneous ignition by e.g. an electrical ignition system and also a self ignition.

Hereinafter is described the four-stroke process with all different types of ignition.

1. Extraneous Ignition

Intake: Through the moving combustion chamber past the intake port, fresh air is sucking into them.

Compression: Fuel is injected and the fuel-air mixture will be compressed in the on and on forwardly moving chamber along the specially milled inner surface of the engine housing.

Work: At the point of the maximum compression density in the combustion chamber and at the moment when the third sliding element, which serves as a stop for the expansion is expelled, the fuel-air mixture is extraneous ignited (e.g., by electrical/electronic ignition), inflamed in only a fraction of a second and thus moves forward the rotary disc.

Exhaust: In the moment when the first sliding element of the combustion chamber (mover) has passed the exhaust port, the burnt gases can escape from this. But only when the first sliding element is past in the next round at the intake port, the third shift element (stop) is reinserted into the engine housing and thus former can now eject completely the burnt gases of the previous working step.

The mixture formation can take place depending on the construction and necessity in different points and times of the compression stroke, or even just before the extraneous ignition. Petrol, gas and hydrogen propulsion, but also alternative energy sources are feasible.

2. Self Ignition

Intake: Through the moving combustion chamber past the intake port, fresh air is sucking into them.

Compression: The sucked in air will be compressed in the on and on forwardly moving chamber along the specially milled inner surface of the engine housing.

Work: At the point of the maximum compression density in the combustion chamber and at the moment when the third sliding element, which serves as a stop for the expansion is expelled, fuel is injected, which is ignited immediately and thus moves forward the rotary disc.

Exhaust: In the moment when the first sliding element of the combustion chamber (mover) has passed the exhaust port, the burnt gases can escape from this. But only when the first sliding element is past in the next round at the intake port, the third shift element (stop) is reinserted into the engine housing and thus former can now eject completely the burnt gases of the previous working step.

The comparatively uncomplicated construction and the compact design, with relatively few components, ensure low dead load. They allow moreover facile functionality and great proper functioning, with few friction and low attrition. This increases the level of efficiency and allows in result in greater energy exploitation.

The operation principles are not restricted to slack point. This material-protecting and virtually vibration-free workflow induces a splendidly smooth operation, reduces its failure proneness and increases contemporary its useful life.

LIST OF REFERENCE SIGN

1 internal-combustion engine
2 engine housing
3 interior space
4 inner wall
5 rotary disc
6 axis of rotation
7 circumferential area
8 first slot
9 second slot
10 first sliding element
11 second sliding element
12 fuel inlet
13 air inlet
34 exhaust outlet
15 compression area
36 ignition area
17 work area
18 combustion chamber
19 ignition device
20 projections
21,22 recesses
23 overlaps
24 slot
25 third sliding element
26 recess
27 gap
28 stabilizing element
29 driving shaft
d outer diameter of the rotary disc
i1, i2 inner diameter of the interior space, inner diameter i2 of the inner wall
r radial distance of the slots.

The invention claimed is:

1. An internal-combustion engine comprising:

an inlet system for delivering air/fuel/air-fuel mixture;

an exhaust system for discharging exhaust gas;

an ignition device;

a drive shaft;

an engine housing, which has an interior space with an inner wall, which section-wise corresponds to a segment of a circular cylinder and section-wise corresponds to a segment which deviates from the form of a circular cylinder;

a rotary disc being centrally rotatably mounted in an interior space around an axis of rotation of the drive shaft;

wherein an intake area, a compression area, an ignition area, a working area, and an exhaust area are formed in the interior space;

wherein the rotary disc is in the form of a circular cylinder;

wherein said rotary disc has only two slots including a first slot and a second slot in the circumferential area, with a first sliding element and a second sliding element being inserted into the first slot and the second slot;

wherein the interior space of the engine housing has a third slot with a third sliding element being inserted;

wherein each sliding element is able to move alone the slot concerned, and is moved alone the slot concerned on rotation of the rotary disc;

wherein an end of the first sliding element facing away from the axis of rotation is guided along the inner wall in the compression area, the ignition area and the working area on rotation of the rotary disc, while an end of the second sliding element facing away from the axis of rotation is guided alone the inner wall in the compression area and at a distance from the inner wall in the working area on rotation of the rotary disc;

wherein the third sliding element has at least one projection which is guided at least in one recess of an overlap of the rotary disc; and wherein the third sliding element is seated according to position at beginning of an expansion phase in an across milled slot in the engine housing.

2. The internal-combustion engine according to claim 1, wherein the segment of the inner wall which deviates from a circular cylindrical shape, is arranged, in the intake area and compression area.

3. The internal-combustion engine according to claim 1, wherein the outer diameter of the rotary disc in an area where the inner wall corresponds to the circular cylinder corresponds to the inner diameter of the interior space and wherein the inner diameter of the inner wall in the area where it deviates from the circular cylindrical shape having a larger diameter than the rotary disc.

4. The internal-combustion engine according to claim 1, wherein the first sliding element and the second sliding element are arranged offset to each other.

5. The internal-combustion engine according to claim 1, wherein the first sliding element and the second sliding element parallel to the axis of rotation each have at least two projections that reach into recesses of the engine housing.

6. The internal-combustion engine according to claim 5, wherein the recesses form a closed curve around the axis of rotation.

7. The internal-combustion engine according to claim 5, wherein the radial distance of the recesses from, the inner wall around the axis of rotation in the compression area, in the ignition area and in the working area remains essentially unchanged.

8. The internal-combustion engine according to claim 1, wherein the rotary disc on front surfaces of the circular cylinder in a racial direction each exhibits an overlap.

9. The internal-combustion engine according to claim 1, wherein the third sliding element upon rotation of the rotary disc along the third slot is moved toward the rotary disc and from the rotary disc away, wherein a guide is formed such that the third sliding element after passing the first sliding element, is moved toward the rotary disc and the first sliding element and the second sliding element have passed an outlet area, is reinserted into the engine housing.

10. The internal-combustion engine according to claim 1, wherein an air inlet is provided and that a fuel inlet is provided by which air and fuel are introduced into a gap between the inner wall and rotary disc.

11. The internal-combustion engine according to claim 1, wherein an ignition-device is provided to ignite a fuel/air mixture in the ignition area which is designed of a gap between the inner wall and rotary disc.

12. The internal-combustion engine according to claim 1, wherein the rotary disc exhibits a shaft for the driving a load.

13. The internal-combustion engine according to claim 1, wherein the first and the second sliding element are slidable in the radial direction.

14. The internal-combustion engine according to claim 1, wherein the two slots are directed toward the axis of rotation.

* * * * *